United States Patent [19]

Feistenauer et al.

[11] Patent Number: 4,934,676

[45] Date of Patent: Jun. 19, 1990

[54] DRIVE FOR A MACHINE VICE

[75] Inventors: Harald Feistenauer, Lindenberg; Ludwig Krause, Kimratshofen, both of Fed. Rep. of Germany

[73] Assignee: Saurer-Allma GmbH, Kempten, Fed. Rep. of Germany

[21] Appl. No.: 278,352

[22] Filed: Dec. 1, 1988

[30] Foreign Application Priority Data

May 6, 1988 [DE] Fed. Rep. of Germany ... 8806051[U]

[51] Int. Cl.[5] ..... B25B 1/10

[52] U.S. Cl. ..... 269/136

[58] Field of Search ..... 269/244, 247, 283, 280, 269/282, 136, 138, 20, 32; 9/401; 92/59, 13.8; 74/110

[56] References Cited

U.S. PATENT DOCUMENTS

| | | | |
|---|---|---|---|
| 3,397,880 | 8/1968 | Kuban . | |
| 3,941,362 | 3/1976 | Arnold | 269/32 |
| 4,043,547 | 8/1977 | Glomb et al. . | |
| 4,067,560 | 1/1978 | Arnold | 269/32 |
| 4,270,398 | 6/1981 | Arnold | 269/32 |
| 4,418,899 | 12/1983 | Zimmermann et al. | 269/32 |
| 4,605,208 | 8/1986 | Durham | 269/32 |
| 4,684,115 | 8/1987 | Krause | 269/136 |

FOREIGN PATENT DOCUMENTS

| | | |
|---|---|---|
| 2308175 | 9/1975 | Fed. Rep. of Germany . |
| 3437403 | 8/1987 | Fed. Rep. of Germany . |

*Primary Examiner*—Robert C. Watson

*Attorney, Agent, or Firm*—Fleit, Jacobson, Cohn, Price, Holman & Stern

[57] ABSTRACT

A drive for a machine vice having a vice body (8), a fixed jaw (9) and a movable jaw (4), a drive spindle (1) rotatably mounted in a thrust block (6) at one end of the vice body adjacent the movable jaw, a slide or drive nut (29) for the movable jaw cooperatively engaging drive screw threads (30) on the spindle so that rotation of the latter actuates the movable jaw, these parts extending on one side of the thrust block (6), a threaded sleeve (11) mounted in the thrust block, an extension (13) on the drive spindle extending rotatably and slidably through the thrust collar, a chamber drive unit (15) threadedly engaged (14) with extension (13) at one end and threadedly engaged at the other end with crankshaft (16) driven at its outer end by a crank (3) so that the crank rotates the drive spindle. A power amplifier (2) is mounted between and engaged with the crankshaft and drive spindle within the chamber drive unit and a releasable ball type clutch (35) is provided between the crankshaft and chamber drive unit so that force on the crankshaft produced by the crank rotatably drives the chamber drive unit which rotates the drive spindle up to a predetermined torque, after which the ball clutch disengages and the crankshaft alone rotates to operate the power amplifier to move the drive spindle linearly.

11 Claims, 2 Drawing Sheets

DRIVE FOR A MACHINE VICE

BACKGROUND OF THE INVENTION

The invention relates to a drive for a moveable jaw of a machine vice, comprising a screw spindle and a power amplifier operable by means of a crank, the drive, which is arranged beneath the clamping plane of the jaws, being supported by means of an annular flange on a thrust block at one end of the vice body, on whose other end the fixed jaw is arranged, and the screw spindle engaging into a spindle nut of the moveable jaw.

A machine vice of the general type described above is described in German patent specification No. 3,437,403 and comprises a fixed jaw which is arranged at one end on a vice body and a moveable jaw which is arranged at the other end. The drive consists of a power amplifier which acts on a screw spindle. The arrangement is made in such a way that the crank is located on one side, the crank acting on the power amplifier on the other side of the thrust block. During the crank movement the moveable jaw is first advanced via the screw spindle, and a workpiece is clamped with a predetermined force. If this force or the torque applied at the crank is exceeded, a coupling disengages and the power amplifier comes into effect and exerts pressure on the screw spindle in the axial direction, which acts on the moveable jaw via a slide. In this way, a workpiece can be clamped with high force into the machine vice, and in particular this makes it unnecessary for very high torques to be transmitted via the thread turns of the threaded spindle, which would considerably limit the service life of the latter.

A power amplifier as is used in the above-mentioned machine vice has been disclosed, for example by German patent specification No. 2,308,175.

U.S. Pat. Nos. 3,397,880 and 4,043,547 have disclosed a machine vice which, with regard to the arrangement of the spindle, the crank, the thrust block and the two jaws, is similar to the machine vice above but the machine vices described do not have a power amplifier. The clamping force is applied solely by the screw movement of the spindle and to clamp the workpieces adequately in position, considerable forces have to be applied to the screw spindle which leads to rapid wear.

It is advantageous in this type of vice that the screw spindle is located below the mounting plane for the workpieces so that it is possible to use a relatively small overall length, since the overall length of the drive is not added to the opening capacity and the jaw dimensions, and it is also possible to exert a downward pull on the moveable jaw which counteracts the yawning of the jaws under the clamping pressure. Furthermore, the construction in which the slide is arranged with essential parts beneath the clamping jaws and is surrounded by the machine body is very robust.

In German Auslegeschrift 1,288,523 a machine vice is described in which the screw spindle is arranged inside the moveable jaw. The thrust block is also accommodated inside the moveable jaw, and the entire drive is located above the clamping plane. In this construction, provision is made for a power amplifier outside the moveable jaw, the power amplifier then acting on the moveable jaw via the screw spindle. In this construction, the vice, together with its parts is adapted to the drive from the outset. A considerable overall length also results, since the overall length of the drive is added to the other dimensions in the retracted position.

BRIEF SUMMARY OF THE INVENTION

The objection of the invention is to create a drive which can be fitted in an existing machine vice which does not have a power amplifier without alteration of the vice body being necessary but with the drive having a power amplifier which enables high clamping pressures to be applied without stressing the spindle thread.

To achieve this object, a drive of the general type described above is provided with the screw spindle located on one side of the thrust block and the power amplifier located on the other side of the thrust block. A sleeve is provided which is supported within an annular flange on the thrust block, through the bore of which an extension of the screw spindle passes such that the power amplifier can act on the extension, and the power amplifier is supported on the thrust block via the sleeve.

The object is achieved in simple manner by the invention, the vice body, the slide and the jaws remaining completely unaltered. The thrust block can also be used.

An advantage of the invention is that installation is simple, only the existing screw spindle having to be replaced by the drive according to the invention.

In a further embodiment of the invention, the drive essentially consists of two parts, one part comprising the screw spindle and the sleeve and the other part comprising the other elements of the drive. Both parts are firmly connected to one another at the thrust block. Splitting up the drive into two parts has the advantage of simple assembly. One part with the screw spindle is to be inserted into the thrust block from one side, and the other part of the drive is connected to the first part from the other side, that is, from the rear of the thrust block. In this way a means of compensating, dimensional tolerances in the dimensions of the thrust block is also created. This can be done in particular by a screw thread being provided on the outside of the sleeve for connecting to the other parts of the drive, and by a plurality of fixable positions being used for the element screwed onto the sleeve. Clearance, which unavoidable occurs in this case. It does not impair the precision of the clamping jaw movement or the rigidity of the machine vice.

The screw spindle can interact with the sleeve in various ways. It is advantageous when the screw spindle can be turned along with the sleeve yet remain moveable axially relative to the sleeve within limits under the action of the power amplifier. A non-rotatable sleeve could also be used but the construction proposed above is to be preferred. A suitable rolling-contact bearing, for example a needle bearing, can be used to reduce the friction between the sleeve and the thrust block.

In a preferred embodiment of the invention, a rotatable chamber drive unit is provided for the power amplifier.

The screw spindle extension protrudes into this chamber drive unit on the thrust-block side while the crankshaft protrudes into the chamber drive unit on the crank side. For the relative movement between the crankshaft and the chamber drive unit in the event of the power amplifier being actuated, an internal thread in which the crankshaft is supported is provided in the chamber drive unit. A disengageable coupling is provided in the chamber drive unit, the coupling limiting the torque which is applied by the crank, and is to be transmitted to the chamber drive unit. This ensures that, during the movement of the moveable jaw, first of all the screw spindle is turned and that then at, a certain clamping force, the coupling disengages and the crankshaft acts on the power amplifier.

The chamber drive unit preferably consists of two parts screwed together, one part accommodating the thread for the crankshaft and the coupling, while the other part is screwed to the sleeve.

It is also preferred that an adjustable rotation limit is provided between the crankshaft and the chamber drive unit. Such a limit has the advantage that the size of the forces which are applied by the power amplifier can be predetermined and for certain work, the same clamping pressure can always be applied. This avoids incorrect clamping of the workpieces, whether they are damaged by an excessive clamping pressure or also whether the clamping pressure is not sufficient.

Such a rotation limit can typically consist of two elements. An annular groove having an end stop is provided and a pin or the like is provided which protrudes into the annular groove, the travel of the pin or the like in the annular groove being freely adjustable, in particular in steps. By suitable design of the thread, i.e. by an adequate pitch, e.g. by means of a double thread, the stroke of the power amplifier can be fully utilize during less than one rotation. This stroke can be subdivided into a plurality of steps, as a result of which the forces which can be applied can have an upper limit which can be determined by the rotation limit.

The invention can utilize for example, a power amplifier as described in the application earlier German patent application P.3,708,021,0. Such a power amplifier, just like the power amplifier according to German patent specification No. 2,308,175 has the advantage of a uniform transmission ratio. But other power amplifiers can also be used in connection with the invention, for example hydraulic power amplifiers having piston areas of different size.

The best results are obtained when all features according to the invention are applied in combination as described. But it is also possible to combine the features according to the invention in another manner or to even use individual features independently of the other features. This applies in particular to the rotation limit, which can also be advantageously used in other constructions of machine vices having power amplifiers.

BRIEF DESCRIPTION OF THE DRAWINGS

An exemplary embodiment of the invention will now be described with reference to the accompanying drawing, wherein.

DETAILED DESCRIPTION

Figure 1:
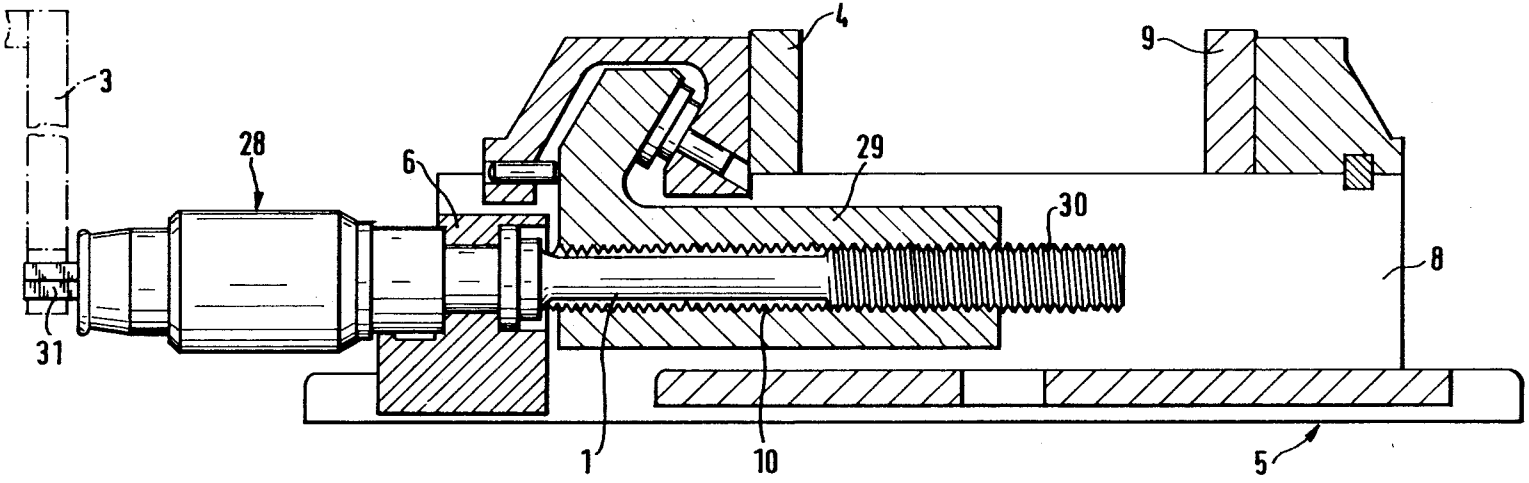
FIG. 1 is a cross-sectional view which shows a machine vice having a drive according to the invention.

In the representation in FIG. 1 the jaw 9 is firmly arranged on the vice body 8 at one end. Provided at the other end of the vice body is the thrust block 6, which accommodates the drive 28 according to the invention. Mounted in the vice body 8 is the slide or spindle nut 29 which carries the moveable jaw 4. The feed movement for the slide 29 is effected by means of the screw spindle 1. The screw spindle 1, with the screw spindle thread 30, engages into the spindle nut 10, which extends over the entire length of the spindle. FIG. 1 shows that position of the machine vice 5 in which the jaw 4 is retracted completely. The feed movement is introduced into the drive via the crank 3, which can be slipped onto the polygon section 31.

Figure 2:
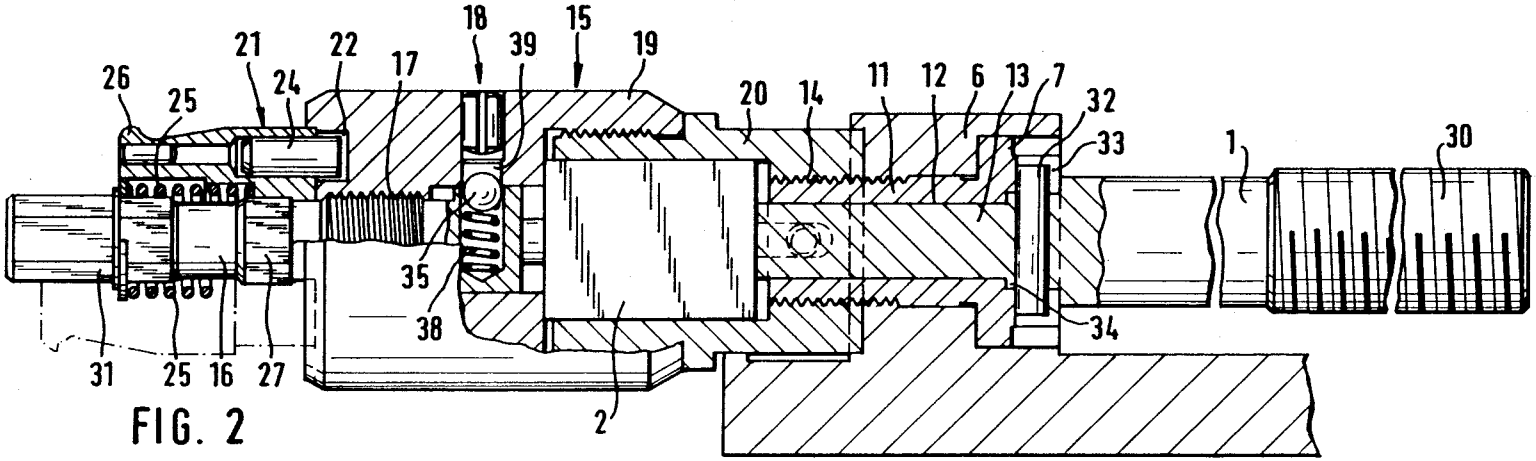
FIG. 2 is an enlarged cross sectional view of details of the drive according to the invention.
Figure 3:
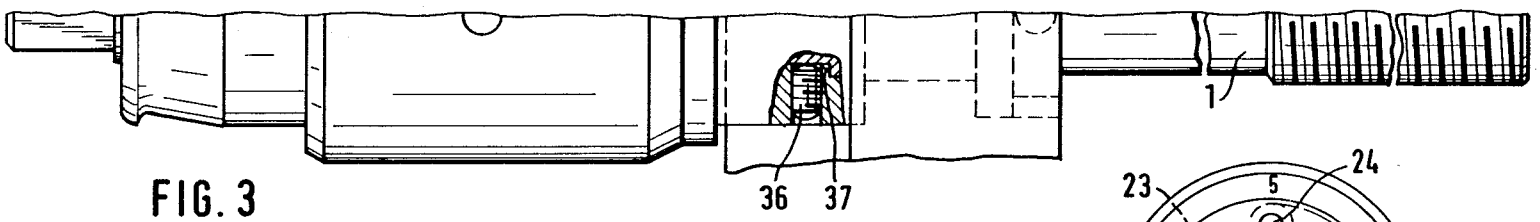
FIG. 3 is a partial top plan view of the representation in FIG. 2.

As shown in FIG. 2 screw spindle 1 protrudes with an extension 13 into the bore 12 of the sleeve 11. A taper pin 32 connects the sleeve 11 and the extension 13 of the screw spindle 1. In this arrangement, the recess 33 in the sleeve 11 is formed as an elongated hole in order to permit an axial movement of the taper pin 32 and thus of the screw spindle 1 relative to the sleeve 11. The sleeve 11, with the annular flange 7, is supported on the thrust block 6. A step 34 is provided to transmit the applied pressures of the screw spindle 1 to the sleeve 11.

The sleeve 11 and the screw spindle 1 form one part of the drive, which in the representation in FIG. 2 is inserted from the right into the bore in the thrust block 6. The drive elements arranged to the left of the thrust block 6 in the representation in FIG. 2 are screwed, with the part 20 of the chamber drive unit 15, onto the external thread 14 of the sleeve 11. When being screwed onto the sleeve 11, the part 20 can be readily adapted to the dimensions of the thrust block 6 by means of a locking screw 36, for which two elongated recesses 37, for example, located opposite one another by 180°, are provided in the sleeve 11. The connection will have only a very slight clearance.

The parts 19 and 20 together form the chamber drive unit 15 which accommodates the power amplifier 2, which is not shown in greater detail.

Held in the internal thread 17 of the part 19 is the crankshaft 16, which acts on the power amplifier when being screwed into the part 19 of the chamber 15. The coupling 18 in the chamber drive unit 15 consists of a ball 35 which is under the action of a spring 38 and partly protrudes into a recess 39 in the part 19. The force of the spring 38 determines a torque which can be transmitted between the crankshaft 16 and the part 19. If the set torque is exceeded, the ball 35 moves inwards against the force of the spring 38 and the screw-in movement of the crankshaft 16 into the chamber drive unit 15 becomes possible.

Figure 4:
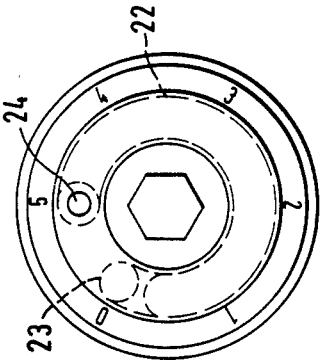
FIG. 4 is a left end view of FIG. 3 showing the crank end of the drive.

A rotation limit 21 is provided on the crankshaft 16 which essentially consists of an annular groove 22 in the part 19 into which a pin 34 engages. The annular groove has an end stop 23 (see FIG. 4) so that the pin 24 has a maximum rotation of about 300°. Since the pin 24 is mounted in the adjusting ring 26 and the adjusting ring 26 is displaceable on the polygon section 27 having six surfaces, against the force of the spring 25, it is possible to pull back the adjusting ring 26 to the left in the representation of FIG. 2, in FIG. 2 against the force of the spring, with the polygon section 27 disengaging, and to fix it in various positions on the hexagon section 27. In the process, a total of five different positions (positions 1–5 in FIG. 4) can be assumed. In position 1, a rotation of only 60° is possible, that is, only a slight actuation of the power amplifier 2. In other positions, however, greater effectiveness of the power amplifier is obtained.

In practical use, the moveable jaw 4, by means of the drive described, that is while using the crank 3, is advanced until the workpiece clamped between the jaws 4 and 9 is secured in position with a force determined by the coupling 18. The screw spindle is turned during this movement. If the ball 35 disengages, the power amplifier 2 comes into action and exerts, via the extension 13 an axial feed force on the screw spindle without turning the latter. The rotation limit 21 ensures an exactly predeterminable and reproducible clamping force.

We claim:

1. In a drive for a machine vice having a vice body, a fixed jaw on one end of the vice body, a movable jaw mounted on the vice body for movement relative to the fixed jaw, a spindle nut on the movable jaw, a thrust block at the other end of the vice body, the drive including a drive screw spindle engaging the spindle nut and connected to a power amplifier and being operable by a crank means, the drive being arranged beneath the clamping plane of the jaws and being supported on the thrust block by an annular flange, the improvement wherein:

the drive screw spindle is disposed on one side of the thrust block;

the power amplifier is disposed on the other side of the thrust block;

a coupling sleeve having an axial bore therethrough and having the annular flange thereon is supported on the thrust block;

an axial extension is provided on the drive screw spindle extending through said axial bore in said coupling sleeve;

said coupling sleeve is connected to said drive screw spindle so that rotation of said coupling sleeve rotatably drives said drive screw spindle;

the power amplifier is supported on said crank means and engages said extension for acting on said extrusion; and said crank means is supported on the thrust block by said coupling means.

2. A drive as claimed in claim 1 wherein:

said drive comprises a first part comprising said drive screw spindle and extension thereon, and said coupling sleeve, and a second part comprising said crank means and power amplifier; and said first and second parts are firmly connected together at the thrust block.

3. A drive as claimed in claim 1 wherein: said crank means comprises:

a rotatable chamber drive unit;

a chamber in said chamber drive unit, said power amplifier being supported in said chamber and said extension on said drive screw spindle protruding into said chamber on the side thereof adjacent the thrust block;

a crankshaft protruding into said chamber on the side thereof opposite said extrusion;

an internal thread on said chamber;

an external thread on said crankshaft engaging said internal thread on said chamber for supporting said crankshaft for rotation relative to said chamber drive unit;

disengageable coupling means between said crankshaft and said chamber drive unit for rotating said chamber drive unit by rotation of said crankshaft and limiting the torque applied to said chamber drive unit by said crankshaft to a predetermined amount above which said coupling means disengages allowing rotation of said crankshaft relative to said chamber drive unit; and means to rotatably drive said crankshaft.

4. A drive as claimed in claim 3 wherein:

said chamber drive means comprises two parts threadedly connected together, one of said parts having said internal thread engaging said crankshaft thereon, and the other of said parts being screw threadedly connected to said coupling sleeve.

5. In a drive for a machine vice having a vice body, a fixed jaw on one end of the vice body, a movable jaw mounted on the vice body for movement relative to the fixed jaw, a spindle nut on the movable jaw, a thrust block at the other end of the vice body, the drive including a drive screw spindle engaging the spindle nut and connected to a power amplifier and being operable by a crank means, the drive being arranged beneath the clamping plane of the jaws and being supported on the thrust block by an annular flange, the improvement wherein:

the drive screw spindle is disposed on one side of the thrust block;

the power amplifier is disposed on the other side of the thrust block;

a coupling sleeve having an axial therethrough and having the annular flange thereon is supported on the thrust block;

an axial extension is provided on the drive screw spindle extending through said axial bore in said coupling sleeve;

said coupling sleeve is connected to said drive screw spindle so that rotation of said coupling sleeve rotatably drives said drive screw spindle;

the power amplifier is supported on said crank means and engages said extension for acting on said extrusion;

an external screw thread is provided on said coupling sleeve;

an internal screw thread is provided on said crank means engaging with said external screw thread on said coupling sleeve; and means are provided for adjustably fixing the position of said crank means on said coupling means.

6. In a drive for a machine vice having vice body, a fixed jaw on one end of the vice body, a movable jaw mounted on the vice body for movement relative to the fixed jaw, a spindle nut on the movable jaw, a thrust block at the other end of the vice body, the drive including a drive screw spindle engaging the spindle nut and connected to a power amplifier and being operable by a crank means, the drive being arranged beneath the clamping plane of the jaws and being supported on the thrust block by an annular flange, the improvement wherein:

the drive screw spindle is disposed on one side of the thrust block;

the power amplifier is disposed on the other side of the thrust block;

a coupling sleeve having an axial bore therethrough and having the annular flange thereon is supported on the thrust block;

an axial extension is provided on the drive screw spindle extending through said axial bore in said coupling sleeve;

said coupling sleeve is connected to said drive screw spindle so that rotation of said coupling sleeve rotatably drives said drive screw spindle;

the power amplifier is supported on said crank means and engages said extension for acting on said extrusion;

said crank means is supported on the thrust block by said coupling means; and said axial extension is axially slidable in said bore in said coupling sleeve within limits by the action of said power amplifier.

7. In a drive for a machine vice having a vice body, a fixed jaw on one end of the vice body, a movable jaw mounted on the vice body for movement relative to the fixed jaw, a spindle nut on the movable jaw, a thrust block at the other end of the vice body, the drive including a drive screw spindle engaging the spindle nut and connected to a power amplifier and being operable by a crank means, the drive being arranged beneath the clamping plane of the jaws and being supported on the thrust body by an annular flange, the improvement wherein:

the drive screw spindle is disposed on one side of the thrust block;

the power amplifier is disposed on the other side of the thrust block;

a coupling sleeve having an axial bore therethrough and having the annular flange thereon is supported on the thrust block;

an axial extension is provided on the drive screw spindle extending through said axial bore in said coupling sleeve;

said coupling sleeve is connected to said drive screw spindle so that rotation of said coupling sleeve rotatably drives said drive screw spindle;

the power amplifier is supported on said crank means and engages said extension for acting on said extrusion; and said crank means is supported on the thrust block by said coupling means and comprises, a rotatable chamber drive unit, a chamber in said chamber drive unit, said power amplifier being supported in said chamber and said extension on said drive screw spindle protruding into said chamber on the side thereof adjacent the thrust block, a crankshaft protruding into said chamber on the side thereof opposite said extrusion, an internal thread on said chamber drive unit, an external thread on said crankshaft engaging said internal thread on said chamber drive unit for supporting said crankshaft for rotation relative to said chamber drive unit, disengageable coupling means between said crankshaft and said chamber drive unit for rotating said chamber drive unit by rotation of said crankshaft and limiting the torque applied to said chamber drive unit by said crankshaft to a predetermined amount above which said disengageable coupling means disengages allowing rotation of said crankshaft relative to said chamber drive unit, drive means to rotatably drive said crankshaft, and rotation limiting means for limiting relative rotation between said drive means and said chamber drive unit.

8. A drive as claimed in claim 7 wherein said rotation limiting means comprises:

an annular groove on said chamber drive unit having an end stop;

an adjustable pin means slidably engaging in said annular groove; and means for adjusting the travel of said pin means in said annular groove.

9. A drive as claimed in claim 8 wherein said pin means comprises:

an adjusting ring rotatably and axially adjustable on said crankshaft;

a pin mounted in said adjusting ring;

spring means resiliently urging said adjusting ring toward engagement of said pin in said annular groove; and means for locking said adjusting ring in a plurality of angular positions on said crankshaft.

10. A drive as claimed in claim 9 wherein said locking means comprises:

interengaging polygon shaped parts on said crankshaft and said adjusting ring, said adjusting ring being axially displaceable against the force of said spring means to disengage said polygon shaped parts to facilitate rotational adjustment of said adjusting ring.

11. A drive as claimed in claim 8 wherein:

said annular groove is on the outer side of said chamber drive unit.

* * * * *